United States Patent [19]

Jacobs et al.

[11] Patent Number: 4,937,931

[45] Date of Patent: Jul. 3, 1990

[54] METHOD OF MANUFACTURING A SADDLE-SHAPED DEFLECTION COIL FOR A PICTURE DISPLAY TUBE

[75] Inventors: Franciscus C. A. J. Jacobs; Nicolaas G. Vink; Franciscus M. P. P. Doomernik, all of Eindhoven, Netherlands

[73] Assignee: U. S. Philips Corporation, New York, N.Y.

[21] Appl. No.: 461,889

[22] Filed: Jan. 8, 1990

[30] Foreign Application Priority Data

Jan. 30, 1989 [NL] Netherlands ..... 8900213

[51] Int. Cl.[5] ..... H01F 41/06

[52] U.S. Cl. ..... 29/605; 140/92.2; 335/213

[58] Field of Search ..... 29/605; 140/92.2, 92.1; 242/7.03, 1, 118; 156/173; 313/426, 428; 335/213

[56] References Cited

U.S. PATENT DOCUMENTS

| | | | |
|---|---|---|---|
| 4,464,643 | 8/1984 | Meersbock | 335/213 |
| 4,694,868 | 9/1987 | Jahnke | 29/605 X |
| 4,819,323 | 4/1989 | Groothoff | 29/605 |

*Primary Examiner*—Carl E. Hall

*Attorney, Agent, or Firm*—Robert J. Kraus

[57] ABSTRACT

Method of continuously winding a saddle-shaped deflection coil flaring from a rear connection portion towards a front connection portion, in which at least one connection portion is given a convex shape during winding and in which after winding the convex connection portion is given a concave shape by means of a die, whereafter the coil turns are united to a compact assembly by means of a heating step.

3 Claims, 2 Drawing Sheets

METHOD OF MANUFACTURING A SADDLE-SHAPED DEFLECTION COIL FOR A PICTURE DISPLAY TUBE

The invention relates to a method of continuously winding in a winding space a saddle-shaped deflection coil flaring from a rear end towards a front end and having a connection portion at its front end and a connection portion at its rear end between which longitudinal turn sections extend.

The above-mentioned method in which a winding space is formed between two winding jig halves is conventionally used for winding saddle-shaped coils. In this method the properties of the coil may be influenced by determining the location of the open spaces during the design and by selecting the number of turns per section during winding. In many cases this provides the possibility of adapting the distribution of the magnetic flux generated by the coil to the requirements imposed. However, it has been found that this possibility is not adequate in all cases, particularly when more refined corrections are to be provided. Such corrections are necessary, for example if certain convergence (field coma) errors are to be reduced in colour display tubes of the in-line type.

If strict requirements are imposed on the performance of a combination of a deflection unit and a display tube, it may be advantageous for the designer of the deflection coil to have an extra modification possibility in the proximity of the rear and/or front end of a deflection coil. The invention provides a solution in those cases where deflection coils of the saddle type (with upstanding or lying front connection portions and upstanding or lying rear connection portions) are used.

According to the invention a method of continuously winding a saddle-shaped deflection coil flaring from a rear connection portion towards a front connection portion is therefore characterized in that at least one connection portion is given a convex shape during winding and in that after winding the convex connection portion is given a concave shape by means of a die, whereafter the coil turns are united to a compact assembly by means of a heating step.

In the method according to the invention a concave connection portion is formed at the front and/or rear coil end. The extent of concavity can be used as an extra design parameter. For the setmaker this means that he can dispense with given correction circuits hitherto required.

An embodiment of the method according to the invention is characterized in that for providing a convex shape at least one symmetrical pair of pins is introduced into the winding space proximate to one ene of the coil and transversely to the plane of the longitudinal turns of the coil at a position which is located outwardly with respect to the end, and in that the connection portion is wound around said pins.

The method is preferably performed in such a way that such a length of wire is used for winding the connection portion of the deflection coil that substantially no mechanical stress is produced when the connection portion is given the concave shape.

Some embodiments of the invention will be described in greater detail with reference to the accompanying drawings in which FIG. 1 is a diagrammatic longitudinal section through a part of a picture display tube with a deflection system;

Figure 1:
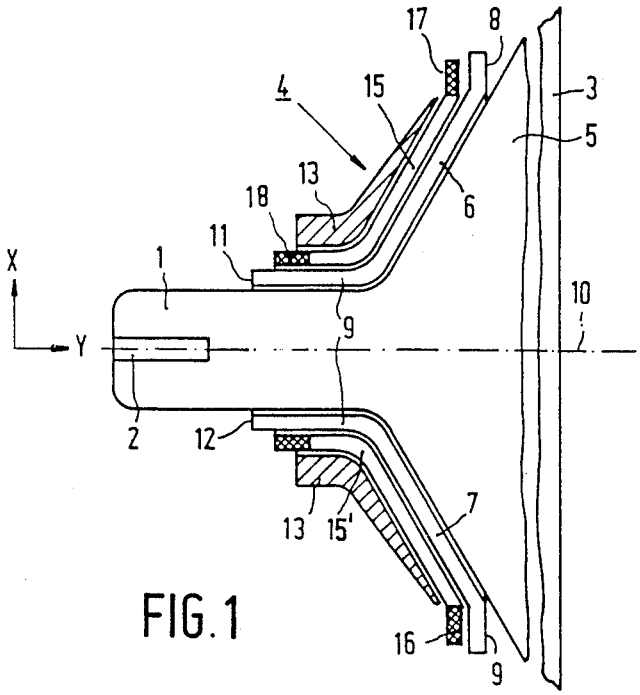

FIG. 1 shows a colour display tube 1 comprising an electron gun system 2 for generating three electron beams which are directed towards a display screen 3 having a repetitive pattern of red, green and blue phosphor elements. An electromagnetic deflection system 4 is arranged around the path of the electron beams coaxially with the axis of the tube between the electron gun system 2 and the display screen 3. The deflection system 4 comprises a funnel-shaped synthetic material coil support 5 which supports a line deflection coil system 6, 7 at its inner side for deflecting the electron beams generated by the electron gun system 3 in a horizontal direction. The flared line deflection coils 6, 7 are of the saddle type and have a front flange 8, 9 at their widest end, which flange is formed by the connection wires between the axial conductor packets and is substantially trasverse to the axis 10 of the display tube. At their narrowest end the coils 6, 7 have packets of connection wires 11, 12 which connect the axial conductor packets of each coil 6, 7 to each other and are laid across the surface of the display tube 1. In the case shown the coils 6, 7 are of the type having a "lying" rear flange.

The coil support 5 supports two saddle-shaped field deflection coils 15, 15' at its outer side for deflecting electron beams generated by the electron gun system 3 in a vertical direction. A ferromagnetic annular core 13 surrounds the two coil sets. In the case shown the field deflection coils are of the type having an upstanding front flange 16, 17 and a lying a rear flange.

The method according to the invention, which will hereinafter be described in greater detail, can be used to give the front flange and/or the rear flange of the coils 15, 15' a desired concave shape. However, the invention is not limited to its use for such types of coils. The invention may also be used, for example to give the front flange of saddle coils having a non-upstanding front flange a desired concave shape. In a (line) saddle coil having a non-upstanding front flange the connection wires are laid across the display tube surfate at the wide end.

The invention can also be used to give the front flange of saddle coils with an upstanding rear flange a desired concave shape.

Figure 2:
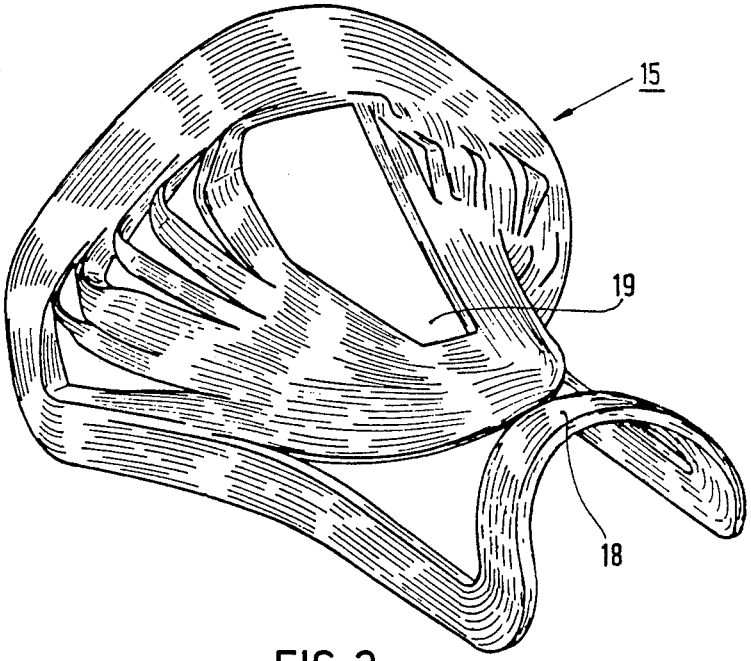
FIG. 2 is a perspective elevational view of a field deflection coil wound by means of the method according to the invention.

If strict requirements (particularly as regards convergence) are imposed on the performance of a combination of a display tube and a deflection unit, it may be advantageous to add an extra positive six-pole component proximate to the rear end of the field deflection coil. FIG. 2 is an elevational view of a (field) deflection coil 15 having a concave lying rear connection portion 18 which satisfies this object. A strong positive six-pole component in the gun-sided part of the vertical deflection field is necessary for field coma correction. (The effect of a positive six-pole component on this dipole deflection field is a pincushion-shaped field variation). For a self-convergent in-line colour system with green as a central beam and red and blue as the outer beams field coma is understood to mean: a vertical displacement of red and blue relative to green. If no coma correction measures are taken, red and blue will be deflected to a stronger extent than green. In the case of a pincushion-shaped deflection field at the gun side red and blue are subjected to a weaker deflection field than green. Red and blue will therefore be deflected to a less strong extent.

A pincushion-shaped field is generated if the window openings of the two saddle coils of a deflection coil systems are large, and a barrel-shaped field is generated if the window openings are small. For a self-convergent system the vertical deflection field in the central region should have a barrel-shaped distribution (the separate saddle-shaped field deflection coils 15, 15' thus must have a small window opening 19 in the centre), a pincushion-shaped distribution at the gun side (: large window opening) and at the flared end a pincushion-shaped distribution which should be stronger as less east-west raster distortion is to be admitted.

Hitherto it has not been found possible to manufacture saddle coils while using the conventional winding methods and with such a strongly varying window opening as is desired for the said uses. Different compromise solutions are known to alleviate the problem. For example, at the gun side a less large window than is actually required may suffice by locally intensifying the pincushion shape of the vertical deflection field by means of segments of soft magnetic metallic material arranged in the vertical deflection field. However, from an energetic point of view, the use of such segments is less desirable.

Within the scope of the invention a field deflection coil, particualarly for use in a colour monitor display system can be wound, which results in that a field deflection field is generated witht the field shape desired for self-convergence and/or east-west raster distortion without additional auxiliary means being required at least at the gun side.

Figure 4:
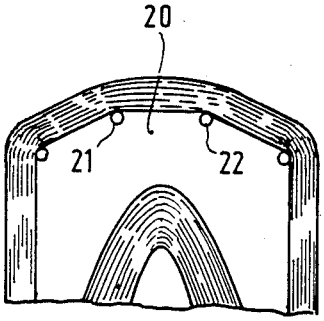
FIG. 4 shows diagrammatically a part of winding device for use of the method according to the invention during a first step of the method and FIG. 5 shows diagrammatically a part of a winding device for use of the method according to the invention during a second step of the method.
Figure 5:
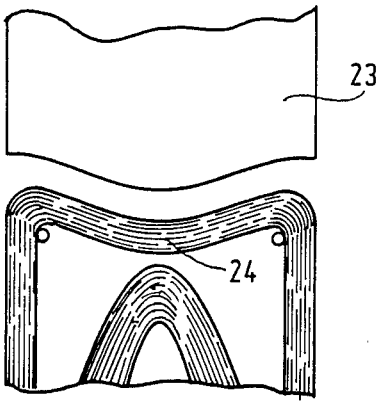

To this end one departs from the method of winding saddle coils with connection portions in which the connection wires follow a circular track when they cross the tube surface. In fact, connection wires crossing in this way have the drawback that there is a fixed relationship, notably between the dipole and six-pole field strength. A coil end connection portion which is concave with respect to a circular track can change this relationship. When manufacturing a deflection coil with such a concave connection portion, extra provisions are found to be necessary to guarantee a good stability of the manufactured coil. In the method according to the invention the connection portion is therefore firstly given a convex shape during winding, which shape is exactly opposite to the ultimately desired concave shape. As is shown diagrammatically in FIG. 4, the convex shape is realised by placing a number of (at least two) auxiliary pins 21, 22 in the surface of winding jig 20, which pins are removed from the winding jig 20 after the coil but before baking and pressing. The extra wound wire length with respect to connection wires crossing in accordance with a circular track is just sufficient to compensate for the increase in length which is used for giving the coil end 24 (FIG. 5) a concave shape by means of an accurately shaped die 23.

Figure 3:
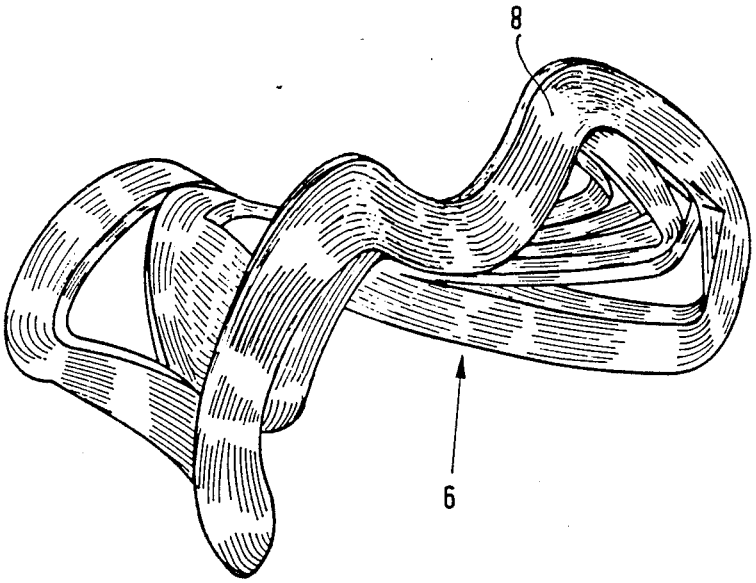
FIG. 3 is a perspective elevational view of a line deflection coil wound by means of the method according to the invention.

The wound wire is not additionally stretched when providing the concave shape so that no mechanical stresses are produced. As it were, the coil is firstly wound in a first stable position and is subsequently brought to a second stable position by means of pressing. This ensures a good temperature stability of the obtained field deflection coil with a concave lying rear end. In this way it is possible to make, for example a field deflection coil which is substantially free from coma. More generally, the inventive method of winding a deflection coil can, however, the used in all those cases where an upstanding or lying flange with connection wires must be given a concave shape. An example of a (line) deflection coil 6 which has a concave (upstanding) front connection portion 8 for the purpose of a good raster performance is shown in FIG. 3.

We claims:

1. A method of continuously winding in a winding space a saddle-shaped deflection coil flaring from a rear end towards a front end and having a connecting portion at its front end and a connection portion at its rear end between which longitudinal turn sections extend, characterized in that at least one connection portion is given a convex shape during winding and in that after winding the convex connection portion is given a concave shape by means of a die, whereafter the coil turns are united to a compact assembly by means of a heating step.

2. A method as claimed in claim 1, characterized in that for providing a convex shape at least one symmetrical pair of pins is introduced into the winding space proximate to one end of the coil and transversely to the plane of the longitudinal turns of the coil at a position which is located outwardly with respect to the end, and in that the connection portion is wound around said pins.

3. A method as claimed in claim 1 or 2, characterized in that such a length of wire is used for winding the connection portion of the deflection coil that substantially no mechanical stress is produced when the connection portion is given the concave shape.

* * * * *